United States Patent [19]

Cameron et al.

[11] 4,130,475

[45] Dec. 19, 1978

[54] PROCESS FOR MAKING PREMIUM COKE

[75] Inventors: Daniel F. Cameron, London; Gary C. Hughes, Louth, both of England; Harry R. Janssen, Ponca City, Okla.

[73] Assignee: Continental Oil Company, Ponca City, Okla.

[21] Appl. No.: 850,176

[22] Filed: Nov. 10, 1977

Related U.S. Application Data

[63] Continuation-in-part of Ser. No. 398,372, Sep. 18, 1973, abandoned, which is a continuation-in-part of Ser. No. 261,871, Jun. 12, 1972, abandoned.

[51] Int. Cl.[2] ..... C10G 9/14; C10G 37/02

[52] U.S. Cl. ..... 208/54; 208/131

[58] Field of Search ..... 208/54, 46, 106, 131

[56] References Cited

U.S. PATENT DOCUMENTS 3,472,761 10/1969 Cameron ..... 208/131

3,547,804 12/1970 Noguchi et al. ..... 208/131

OTHER PUBLICATIONS

Scott et al., "Trends in the Production of Metallurgical Grade Petroleum Cokes", AIME Symposium on Light Metals (1971), New York, pp. 277 to 295.

Kosch et al., "The Oil and Gas Journal", Jan. 2, 1956, pp. 89 & 90.

*Primary Examiner*—Herbert Levine

*Attorney, Agent, or Firm*—Richard W. Collins

[57] ABSTRACT

A process for producing premium delayed petroleum coke suitable for manufacture of graphite electrodes for use in electric arc steel furnaces. The process requires a fresh feedstock having specific characteristics, and incorporates an internally produced thermal tar as a supplement to the fresh feed. The fresh feedstock is an atmospheric reduced crude petroleum oil having a specified gravity, carbon residue and boiling distribution.

7 Claims, 2 Drawing Figures

PROCESS FOR MAKING PREMIUM COKE

RELATED APPLICATIONS

This application is a continuation-in-part of co-pending Application Ser. No. 398,372 filed Sept. 18, 1973 for Electrode Grade Petroleum Coke Process, which in turn is a continuation-in-part of Application Ser. No. 261,871 filed June 12, 1972 for Electrode Grade Petroleum Coke Process and both now abandoned.

BACKGROUND OF THE INVENTION

1. Field of the Invention

This invention relates to a process for producing premium coke suitable for manufacture of graphite electrodes for use in electric arc furnaces used in the steel industry.

The electric arc steel making process utilizes large graphite electrodes, having a diameter of from 0.5 to 1 meter, and in order for such electrodes to stand up to this severe use, it is necessary that they be formed from coke of the type generally designated "premium".

Premium delayed petroleum coke has been manufactured for many years and has been called by many names. For example, premium petroleum coke has been called No. 1 coke, electrode grade coke, needle coke, and premium coke. Premium coke is ground, calcined, mixed with a binder pitch, extruded, baked and then graphitized to form graphite electrodes. Premium coke can be distinguished from ordinary, regular, or No. 2 petroleum coke by its predominant metallic, striated, crystalline appearance and its tendency to break into long, splintery, acicular particles when crushed to a fine size. Regular or ordinary petroleum coke is more or less amorphous, has a dark, spongy appearance and breaks into lumps of irregular shape. Premium coke has a low linear coefficient of thermal expansion (CTE). There are several ways of determining and expressing this characteristic. A CTE of $7.0 \times 10^{-7}/°$ C. or less as measured by the optical lever method on a graphite rod over a temperature range of from 30 to 98° C. is generally required to produce a satisfactory electrode. A CTE of $5.0 \times 10^{-7}/°$ C. or less is much preferred, particularly for larger diameter electrodes. As used herein, the term premium coke means delayed petroleum coke having a CTE as defined above of not more than $7.0 \times 10^{-7}/°$ C.

2. Description of the Prior Art

The principal raw materials used for the production of premium grade coke in the past have been carefully selected highly aromatic petroleum refinery residue streams obtained from catalytic and thermal cracking processes. Virgin reduced crude oil has been considered unsuitable as a feedstock for manufacture of premium coke, and in fact such virgin reduced crudes are unsuitable in almost all instances.

U.S. Pat. No. 2,745,794 discloses a combination refinery process including coking, thermal cracking and catalytic cracking. The coke produced in the process is regular grade coke.

U.S. Pat. No. 2,775,549 to Shea discloses an early process for making premium coke from certain petroleum residues.

In U.S. Pat. No 2,922,755 to Hackley, a process is disclosed wherein reduced crude can be mixed with thermal tar to produce a mixture which results in a premium grade coke upon carrying out the delayed coking process provided that this reduced crude is present in the weight percent range of about 10 to about 30.

An article by K. E. Rose in *Hydrocarbon Processing*, July 1971, pp. 85–92, discusses delayed coking in general, and in particular describes certain coking feedstocks for both premium and regular coke.

In the past, premium coke has been prepared by operating the process on a blocked-out operation. Blocked-out refers to operation of any portion of a process using steams coming from or going to a storage tank. The thermal tar produced from regular coker gas oils is segregated and charged separately to a premium coker on blocked-out operations to make premium grade coke wherein the charge to the coker is primarily thermal tar produced by thermal cracking of a regular coker gas oil stream.

A process for the simultaneous manufacture of regular and premium coke is described in U.S. Pat. No. 3,472,761 to Cameron.

A typical process for making regular coke is described in an article by Kasch et al in the Jan. 2, 1956 issue of *The Oil and Gas Journal*.

SUMMARY OF THE INVENTION

According to the present invention, a process is provided for continuously producing 100 percent premium grade coke from an atmospheric reduced crude feedstock having specific characteristics without the addition of thermal tar from any outside source. In this process the feedstock is mixed with a thermal tar produced internally and then charged to a coker fractionator. Bottoms material from the coker fractionator is charged to a coker furnace where it is heated to coking temperature, such as about 910–945° F., and the charged to a coke drum maintained at a suitable pressure such as from 35–100 psig where the premium delayed coking process takes place. Vapor from the coke drum including coker gas oil passes back to the coker fractionator where it is split into a light coker gas oil having a boiling range of from about 400 to 650° F. and a heavy coker gas oil consisting of the 650° F.+ fraction. The light coker gas oil passes to a thermal cracker fractionator and the to a light oil cracking furnace from which the products are returned to the thermal cracker fractionator. The heavy coker gas oil from the coker fractionator passes to the thermal cracker fractionator and from the thermal cracker fractionator to a heavy gas oil cracking furnace where it is cracked and returned to the thermal cracker fractionator. The mixture of thermal tars from the light oil cracking furnace and heavy oil cracking furnace is withdrawn from the bottom of the thermal cracker fractionator and charged back to the coker fractionator where it is mixed with reduced atmospheric crude and the cycle is completed. The coke produced in the coke drum is withdrawn from the bottom of the coke drum and further processed to produce a coke suitable for preparation of electrodes used in electric arc steel furnace operations. All of the coke produced in this process is premium coke suitable for such electrodes, and it is not necessary in this process, in contrast to the process described in U.S. Pat. No. 3,472,761, to produce regular coke along with the premium coke. Premium coke is much more valuable than regular coke, and the ability of the process of the invention to produce all premium coke rather than part premium and part regular coke is very desirable and quite unexpected, particularly when considering that the sole or predominant external feed to the process is an atmospheric reduced crude oil, a material normally considered unsuitable for manufacture of premium coke.

It is an object of the present invention to provide a process wherein atmospheric reduced crude is utilized as the only fresh feed or as the predominant fresh feed to a process which produces premium coke as the sole coke product from the process.

DESCRIPTION OF THE PREFERRED EMBODIMENTS

Figure 1:
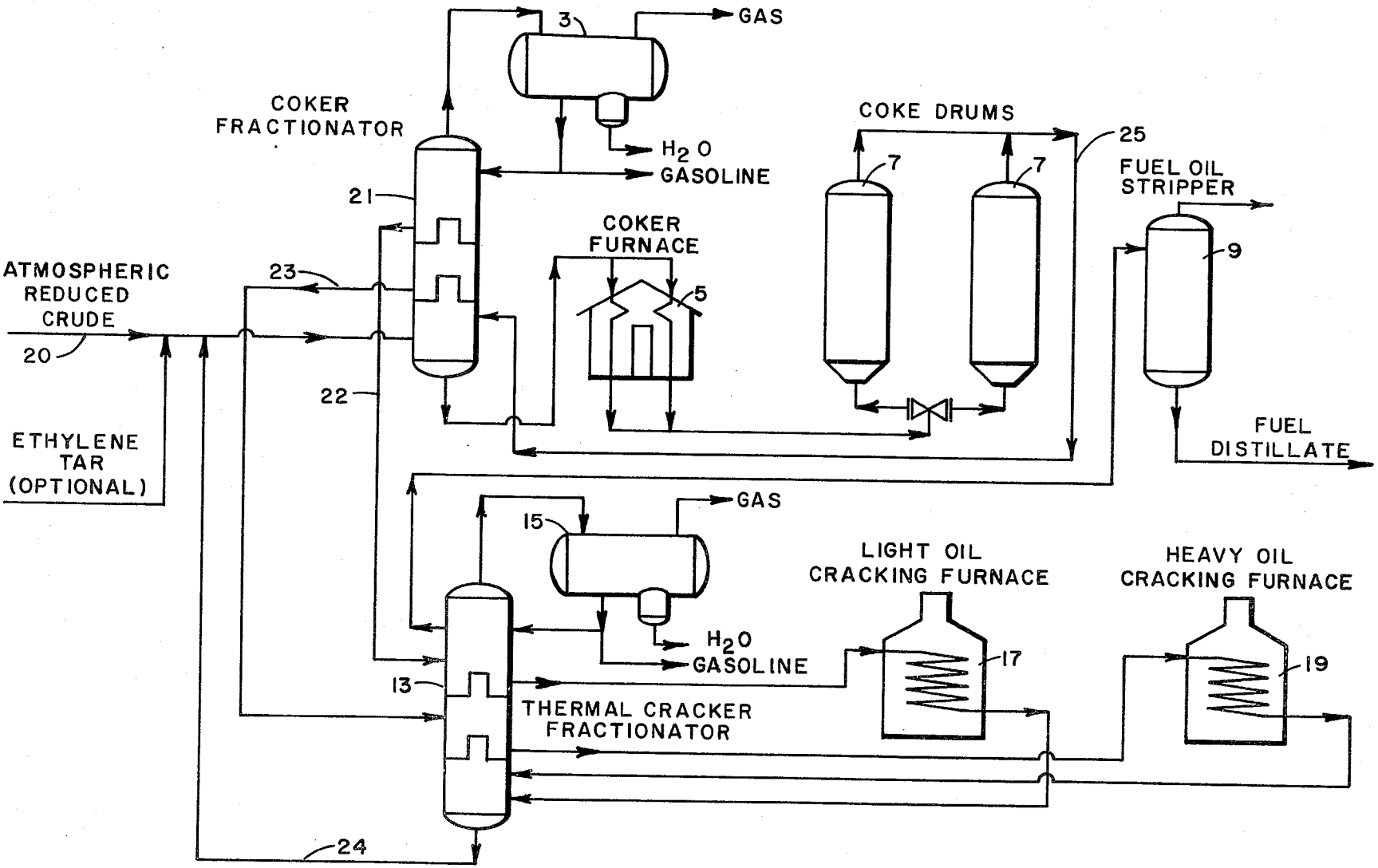
FIG. 1 is a schematic flowsheet illustrating an embodiment of the invention wherein atmospheric reduced crude oil, optionally with ethylene tar, is fed directly to the coker fractionator.

As illustrated in the drawings, this invention is directed to an integrated delayed coking and thermal cracking process.

The unique feature of the invention is that all of the coke produced in the process is premium coke as described hereinabove.

In order for the process of this invention to produce only premium coke, as contrasted to the process of U.S. Pat. No. 3,472,761 which simultaneously produces both premium and regular grades of coke, the external feedstock to the process must possess certain critical properties. Specifically, the feedstock must be an atmospheric reduced crude having an API gravity of from 20 to 30, a Conradson carbon residue (CCR) of no more than 6.0 weight percent, and a boiling distribution according to ASTM Method D-1160 as follows:

| Vol. % | Temp. ° F |
|---|---|
| 5 | 450–700 |
| 10 | 500–750 |
| 20 | 570–820 |
| 30 | 630–880 |
| 40 | 670–940 |
| 50 | 720–990 |
| 60 | 900+ |

Atmospheric reduced crude, sometimes referred to as topped crude, is obtained by distillation of virgin crude oil at essentially atmospheric pressure, and such distillation is generally the initial step in a crude oil refining process. The atmospheric distillation removes the low boiling components of the crude oil boiling up to about 400° to 650° F. It should be noted that only atmospheric reduced crudes having the critical properties set forth above are suitable for the process of this invention. Most atmospheric reduced crudes do not have all the properties enumerated, and are not satisfactory for the process of the invention. An example of an atmospheric reduced crude having the properties needed for the invention is one obtained from Minas crude, which typically has the following properties:

| | | |
|---|---|---|
| Gravity - ° API | 27.9 | |
| Conradson Carbon Residue | 4.6 | |
| | ° F | Vol. % |
| Boiling Distribution | 522 | 5 |
| | 713 | 10 |
| | 788 | 20 |
| | 842 | 30 |
| | 893 | 40 |
| | 961 | 50 |
| | 1002 | 60 |

The conditions in the coking and thermal cracking steps of the process of the invention are conventional for producing premiun coke and thermal tar for premium coker feed respectively, and are well understood by those skilled in the art.

The essence of the invention is not in any new operating condition in the coking or thermal cracking areas, but is rather in the discovery that selected feedstocks having certain properties can be utilized as the sole or predominant outside feed to an integrated coking and thermal cracking process which produces premium coke as the sole coke product.

A typical plant utilizing the process of this invention can be described as a completely self-contained battery limits plant. It consists of a delayed coker unit, a thermal cracking unit, a gas recovery unit with product treating facilities, a coke calciner unit, utility facilities, and product and feed storage with loading facilities. This process can produce 100 percent premium coke from a feedstock comprised of 100 percent atmospheric reduced crude, with the addition of up to 10 volume percent of ethylene tar being optional. In addition to coke, the process produces fuel gas, propane, butane, naphthas, fuel distillates, and other hydrocarbon products.

A plant utilizing this process is unique because of the fact that it can produce premium coke as the sole coke product from atmospheric reduced crude oil. In the past, the thermal tar for making premium coke was produced from regular coker gas oil obtained from a coking process for making regular coke. In the process of this invention, a continuous process is utilized wherein the total feedstock to the system can be an atmospheric reduced crude oil, and the thermal tar needed is produced internally, rather than being produced externally in a regular coking operation as is conventional.

The process of the invention, in the embodiment illustrated in FIG. 1, will now be described.

Atmospheric reduced crude having the critical properties recited hereinabove is fed through line 20 to coker fractionator 21. Optionally, up to 10 volume percent of ethylene tar may be combined with the atmospheric crude. Ethylene tar is a redsidue resulting from a conventional petrochemical process for making ethylene, and is often used in small amounts as a premium coker feedstock.

A light gas oil and a heavy gas oil from coker fractionator 21 are taken through lines 22 and 23 respectively to a thermal cracking unit comprised of thermal cracker fractionator 13 and cracking furnaces 17 and 19. Light and heavy gas oil streams from thermal cracker fractionator 13 pass respectively to light oil cracking furnace 17 and heavy oil cracking furnace 19 where they are thermally cracked, and the products from the cracking furnaces are returned to thermal cracker fractionator 13. The gas oil streams could be taken directly from coker fractionator 21 to the cracking furnaces, if desired. The tars from the cracking furnaces come off the bottom of the thermal cracker fractionator through line 24 and are combined with the external feedstock going to cocker fractionator 21. The thermal tars and the heavier components of the external feedstock come off the bottom of coker fractionator 21 and are passed through coker furnace 5 where they are heated to coking temperature. The heated material from coker furnace 5 is then passed to one of the coke drums 7. Volatile materials from coke drum 7 passes overhead through line 25 and is returned to coker fractionator 21. This volatile material includes gas oils which are retained in the system, and lighter streams such as gasoline and gas products are taken from the upper portion of coker fractionator 21 and recovered through separator 3. Additional lighter components are recovered from the upper portion of thermal cracker fractionator 13 through separator 15 and fuel oil stripper 9.

It will be noted that the only external feed to the process as illustrated in FIG. 1 and described above is an atmospheric reduced crude, with up to 10 percent of an ethylene tar component. It has been found in accordance with the invention that the entire coke product from the process is premium coke. The ability to produce premium coke as the sole coke product in this process is attributed to the use of the specific properties of the atmospheric reduced crude utilized as feedstock. Atmospheric reduced crude streams having API gravities outside the required range, having Conradson carbon residue levels in excess of the range specified, or having boiling distribution patterns outside the range specified, do not reliably produce premium coke when processed according to this invention.

Figure 2:
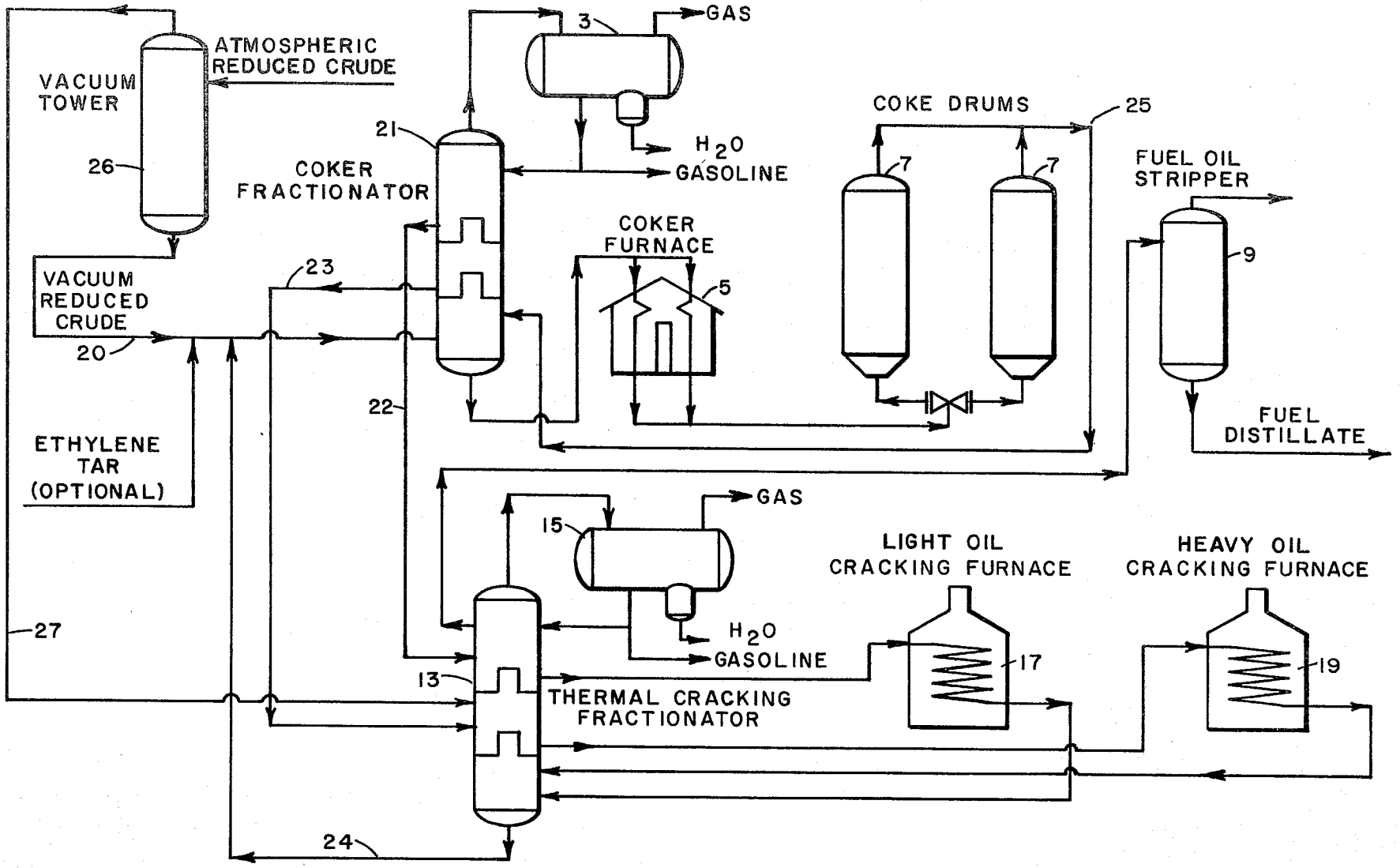
FIG. 2 is a schematic flowsheet illustrating an embodiment of the invention wherein atmospheric reduced crude is subjected to vacuum distillation to produce a vacuum resid stream and a gas oil stream, with the vacuum resid being fed to a coker fractionator and the gas oil being fed to a thermal cracker fractionator.

Another embodiment of the invention is illustrated in FIG. 2, and will now be described.

In this embodiment, everything is essentially identical to the process described with reference to FIG. 1 except that the atmospheric reduced crude is processed through a vacuum distillation column 26 prior to being fed to the process. A vacuum resid fraction is taken from the bottom of column 26 and charged directly to coker fractionator 21 through line 20. The fraction of the atmospheric reduced crude distillable in vacuum column 26 is taken overhead through line 27 and charged directly to thermal cracker fractionator 13. The use of the vacuum tower reduces the initial input to coker fractionator 21 and coker furnace 5 such that a lower volume of material is processed through these units. This provides certain operating efficiencies in that the gas oil fraction of the atmospheric reduced crude does not have to be processed through the coker fractionator and the coker furnace, but rather can be taken directly to the thermal cracker fractionator and subsequently to the cracking furnaces. The coking conditions and the thermal cracking conditions in accordance with this embodiment of this invention are the same as in the case where the atmospheric reduced crude is processed directly through the coker fractionator 21. Again, the use of atmospheric reduced crude having the properties specified herein enables the production of premium coke as the sole coke product from the process.

We claim:

1. A process for producing premium coke from an atmospheric reduced crude feedstock comprising:

(a) charging a feedstock of from 90 to 100 volume percent of an atmospheric reduced crude and up to 10 volume percent ethylene tar to a coker fractionator, said atmospheric reduced crude having an API gravity of from 20 to 30, a Conradson carbon residue of no more than 6.0 percent, and a boiling distribution as follows:

| Volume Percent | Temperature - ° F |
|---|---|
| 5 | 450–700 |
| 10 | 500–750 |
| 20 | 570–820 |
| 30 | 630–880 |
| 40 | 670–940 |
| 50 | 720–990 |
| 60 | 900+ |

(b) charging a bottom stream from said coker fractionator to a coker furnace and heating said bottom stream to coking temperature;

(c) charging said heated bottom stream to a coking drum maintained at premium coking conditions to produce premium coke therein;

(d) passing overhead vapors from said coking drum to said coker fractionator;

(e) withdrawing gas oil from said coker fractionator and charging it to a thermal cracking unit where it is thermally cracked in thermal cracking furnace means to produce an effluent thermally cracked material including thermal tar;

(f) passing effluent from said thermal cracking furnace means to a thermal cracker fractionator;

(g) withdrawing thermal tar from said thermal cracker fractionator and combining said thermal tar and said atmospheric reduced crude; and (h) recovering premium coke from said coke drum, said premium coke being the sole coke product produced in said process.

2. The process of claim 1 wherein said gas oil comprises a light gas oil stream and a heavy gas oil stream.

3. The process of claim 2 wherein said light and heavy gas oil streams are charged to said thermal cracker fractionator before being charged to said thermal cracking furnace means.

4. The process of claim 3 wherein said thermal cracking means comprises a light gas oil cracking furnace and a heavy gas oil cracking furnace.

5. The process of claim 1 wherein said atmospheric reduced crude is initially charged to a vacuum distillation column where it is separated into a vacuum reduced crude fraction and a gas oil fraction, said vacuum reduced crude then being charged to said coker fractionator and said gas oil fraction from said vacuum distillation column being charged to said thermal cracking unit.

6. The process of claim 5 wherein said gas oil fraction from said vacuum distillation column is charged to said thermal cracker fractionator.

7. The process of claim 6 wherein said thermal cracking furnace means comprises a light gas oil cracking furnace and a heavy gas oil cracking furnace.

* * * * *